US007959241B2

(12) United States Patent
Kohlmann et al.

(10) Patent No.: US 7,959,241 B2
(45) Date of Patent: Jun. 14, 2011

(54) PULLOUT STRUCTURE FOR CABINET

(75) Inventors: Michael Kohlmann, Sheboygan, WI (US); Daniel N Halloran, Saukville, WI (US); Matthew M. Smeltzer, Blue Grass, IA (US); Scott R. Krebs, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 831 days.

(21) Appl. No.: 11/739,869

(22) Filed: Apr. 25, 2007

(65) Prior Publication Data

US 2008/0265727 A1 Oct. 30, 2008

(51) Int. Cl.

| | |
|---|---|
| ***A47B 67/02*** | (2006.01) |
| ***A47B 95/00*** | (2006.01) |
| ***A47F 5/08*** | (2006.01) |
| ***E06B 1/00*** | (2006.01) |

(52) U.S. Cl. ..... 312/245; 312/319.2; 312/325; 312/321.5

(58) Field of Classification Search ..... 312/324, 312/326, 325, 329, 245, 229, 228, 269, 271, 312/273, 274, 275, 319.2, 321.5; 16/366, 16/281, 282, 286–288; 4/630, 638, 619; 49/386, 246, 247, 253

See application file for complete search history.

(56) References Cited

U.S. PATENT DOCUMENTS

| | | | | | |
|---|---|---|---|---|---|
| 264,749 | A | * | 9/1882 | Potts | 312/201 |
| 316,294 | A | * | 4/1885 | Roberts | 312/331 |
| 806,277 | A | * | 12/1905 | McKee | 248/128 |
| 1,669,740 | A | * | 5/1928 | Dewey | 362/538 |
| 2,537,669 | A | | 1/1951 | Honig | |
| 2,667,396 | A | * | 1/1954 | Liggett | 312/248 |
| 2,723,175 | A | * | 11/1955 | Berry | 312/269 |
| 3,165,368 | A | * | 1/1965 | Hughes et al. | 312/242 |
| 3,205,032 | A | * | 9/1965 | Leigh | 312/223.1 |
| 3,857,623 | A | * | 12/1974 | Schneller | 312/266 |
| 4,194,452 | A | * | 3/1980 | Crowther et al. | 108/138 |
| 4,727,680 | A | * | 3/1988 | Lewis et al. | 49/260 |
| 4,729,616 | A | * | 3/1988 | Vogt | 312/325 |
| 4,915,461 | A | * | 4/1990 | Kingsborough et al. | 312/247 |
| 5,220,747 | A | * | 6/1993 | Cherry et al. | 49/386 |
| 5,224,677 | A | * | 7/1993 | Close | 248/292.11 |
| 5,249,858 | A | * | 10/1993 | Nusser | 312/319.6 |

(Continued)

FOREIGN PATENT DOCUMENTS

| | | |
|---|---|---|
| DE | 814205 | 9/1951 |

(Continued)

OTHER PUBLICATIONS

Oct. 9, 2008 PCT/US2008/004587 second ISR report on corresponding application.

(Continued)

*Primary Examiner* — Darnell M Jayne
*Assistant Examiner* — Timothy M Ayres
(74) *Attorney, Agent, or Firm* — Quarles & Brady LLP

(57) ABSTRACT

A pullout storage structure for a bathroom cabinet, such as a vanity or medicine cabinet, has a hinge linkage for moving a storage unit between an opened and a closed position such that the storage unit travels an arcuate path and maintains its orientation. Smooth and easy movement of the pullout storage structure is facilitated by an over-center assist member. The assist member tends to close, and keep closed, as well as open, and keep open, the pullout structure.

20 Claims, 12 Drawing Sheets

U.S. PATENT DOCUMENTS

| | | | | |
|---|---|---|---|---|
| 5,407,261 | A * | 4/1995 | Mercer | 312/248 |
| 5,592,780 | A * | 1/1997 | Checkovich | 49/386 |
| 5,722,202 | A * | 3/1998 | Cooper | 49/109 |
| 5,857,756 | A * | 1/1999 | Fehre | 312/246 |
| 6,099,096 | A * | 8/2000 | Lambright | 312/321.5 |
| 6,520,610 | B1 * | 2/2003 | Miller | 312/277 |
| 6,588,865 | B2 | 7/2003 | Caldwell et al. | |
| 6,694,544 | B2 * | 2/2004 | Piatt | 4/661 |
| 6,889,404 | B2 * | 5/2005 | Lu et al. | 16/287 |
| 6,951,374 | B2 | 10/2005 | Swenson | |
| D532,627 | S * | 11/2006 | Nowotarski et al. | D6/446 |
| 7,232,196 | B2 * | 6/2007 | Kwon et al. | 312/402 |
| 2003/0042828 | A1 * | 3/2003 | Bonin | 312/245 |
| 2004/0103473 | A1 * | 6/2004 | Piatt et al. | 4/619 |
| 2005/0073225 | A1 * | 4/2005 | Kwon et al. | 312/402 |
| 2007/0020078 | A1 * | 1/2007 | Frey | 414/686 |

FOREIGN PATENT DOCUMENTS

| | | |
|---|---|---|
| DE | 29704098 | 4/1997 |
| FR | 2652248 | 3/1991 |
| GB | 763253 | 12/1956 |
| GB | 954398 | 4/1964 |
| JP | 2005279021 | 10/2005 |

OTHER PUBLICATIONS

Five pages of a Mar. 1, 2010 European report in the corresponding application EP08727323.1.

* cited by examiner

10

14
67
82
70
67
12
80
80
80
56
80
70
60
46
52
58
12
44
36
50
48
70
34
68
70
80
54
80
54
68
67

10
12
14
67
12
67
70
82
64
70
64
58
62
66
80
64
70
82
70

PULLOUT STRUCTURE FOR CABINET

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

The present invention relates to a storage structure for a cabinet. More particularly, it relates to a pullout storage structure for use in a bathroom cabinet.

Cabinetry has evolved from a simple box having a door or drawer, to complex geometries including a mixture of doors, drawers, shelves and compartments. Cabinetry is no longer viewed as purely utilitarian; users have begun to demand more from high-end products. Cabinetry must now incorporate a bold look and sophisticated features (e.g., built-in televisions, speakers, LED lighting, etc.) in addition to the traditional utilitarian aspects users have come to expect (e.g., storage space, durability, ease of use, etc.).

While most cabinets provide storage, improve organization, and conceal the contents, more innovative designs provide the traditional utilitarian features while incorporating modern amenities. Furthermore, to be economical, the cabinetry must be easily manufactured, installed, adjusted, operated and maintained.

Traditional cabinets have numerous drawbacks. Oftentimes, in order to conceal stored items and maintain a clean appearance, the items are stored behind doors or placed into drawers. While this allows the items to be hidden away when not in use, locating items placed on high shelves (e.g., such as a high-mounted medicine cabinet) or deep within dark, crowded drawers (e.g., drawers of a vanity) can be difficult. As a further example, many medicine cabinets provide a mirrored surface on the outside of the cabinet; however, to access items within the cabinet the door, and hence mirror, must be pivoted away from the user. As a result, the user cannot both view the contents of the cabinet and the mirror simultaneously.

Thus, a need continues to exist for cabinetry that provides convenient access to and storage of items for use in a bathroom.

SUMMARY OF THE INVENTION

The present invention is a pullout storage structure for a bathroom cabinet that addresses many of the shortcomings of current cabinetry. The invention provides convenient, ergonomic access to stored items while allowing the items to remain hidden from view when not in use. Access to stored items within the cabinet is achieved by moving the items toward the user in a consistent orientation without obstructing the user's view of the remainder of the cabinet. Furthermore, an assist member assists in opening and closing the storage structure.

In one aspect, the invention provides a pullout storage structure for a bathroom cabinet including a storage unit coupled to a support member. The storage unit is movable between a first position, a second position, and an intermediate position located between the first position and the second position. Additionally, an assist member assists the storage unit toward the first position when the storage unit is between the first position and the intermediate position and assists the storage unit toward the second position when the storage unit is between the second position and the intermediate position.

In another aspect, the invention provides a hinge linkage for movably mounting a storage unit to a bathroom cabinet. The hinge linkage includes a first set of links having opposite stationary and movable ends. The stationary ends of the links are adapted for pivotal mounting at a first end of a storage compartment of the cabinet. A second set of links has opposite stationary and movable ends, the stationary ends being adapted for pivotal mounting at a second end of the storage compartment. Additionally, a cross-member is pivotally coupled to the storage unit. The cross-member has a first end coupled to the movable ends of the first set of links and a second end coupled to the movable ends of the second set of links such that as the first and second sets of links are pivoted with respect to the cabinet, the cross-member moves along an arcuate path while maintaining an essentially constant orientation.

In still another aspect, the invention provides a bathroom cabinet including a cabinet base having a storage compartment. A movable storage unit having a support platform for storing items, which in a first position is disposed within the storage compartment with a front side of the storage unit being at a front side of the cabinet base. A hinge mounts the storage unit to the cabinet base such that the storage unit can move from the first position along an arcuate path to a second position in which the front side of the storage unit is spaced from the cabinet base. The storage unit is essentially in the same orientation in the first and second positions and can even stay in that orientation as it travels.

These and other advantages of the invention will be apparent from the detailed description and drawings. What follows are one or more preferred embodiments of the present invention. To assess the full scope of the invention the claims should be looked to, as the example embodiments are not intended as the only embodiments within the scope of the invention.

DETAILED DESCRIPTION OF THE PREFERRED EMBODIMENTS

Figure 16:
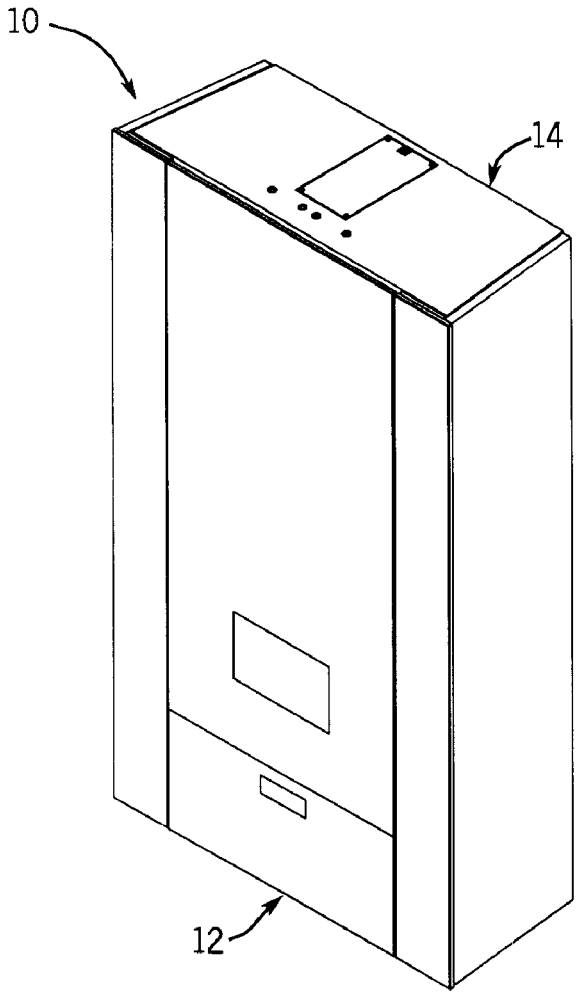
FIG. 16 is a perspective view of an additional embodiment of the invention in which the pullout storage structure is positioned horizontally in a bathroom cabinet.
Figure 17:
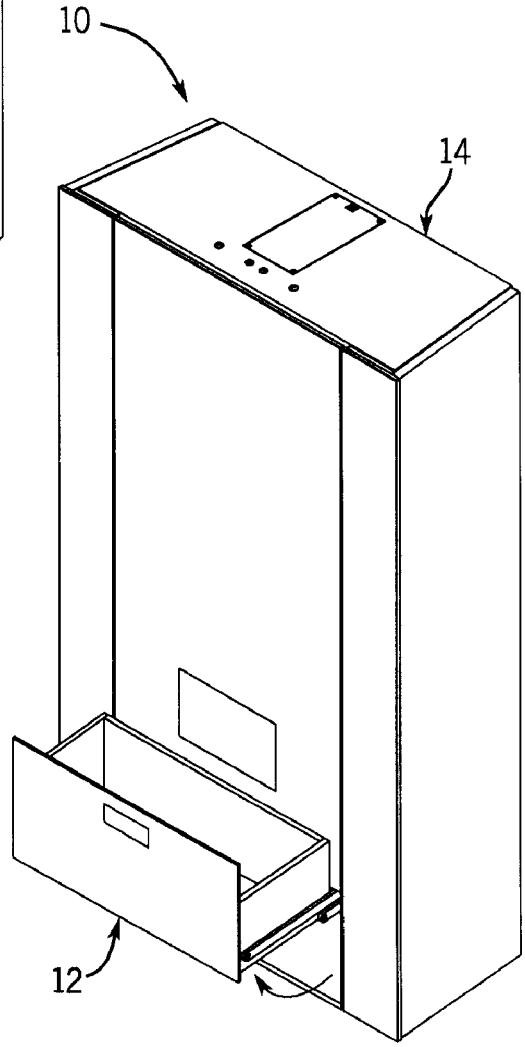
FIG. 17 is a perspective view thereof showing the pullout storage structure in an open position.

A wall-mounted medicine cabinet will be referenced to describe an example embodiment of the invention. It should be noted, however, that the invention is not limited to wall-mounted cabinets, but is equally applicable to vanities, cabinets, and the like, of all elevations (e.g., floor-, wall-, and ceiling-mounted vanities/cabinets). Additionally, while the example embodiment describes a vertically oriented pullout storage structure, the invention contemplates and covers horizontally oriented pullout storage structures and storage structures of any intermediate orientation, such as shown in FIGS. 16 and 17.

Figure 1:
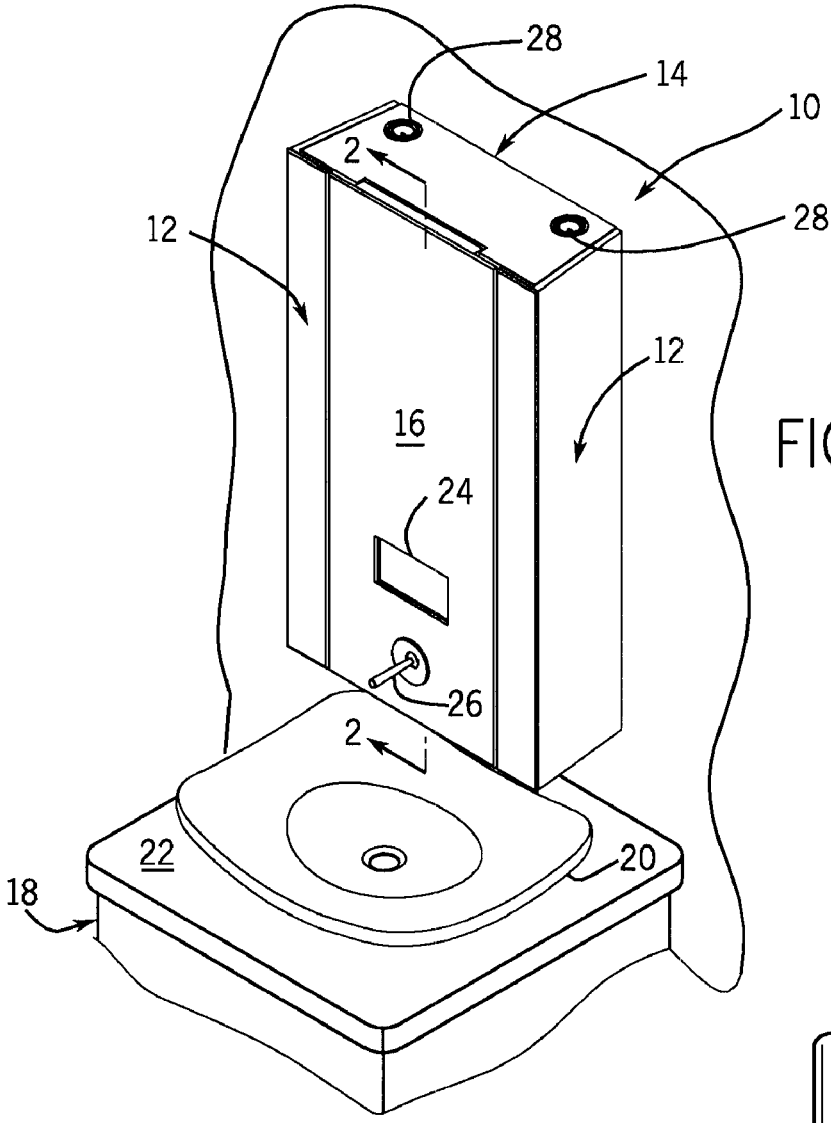
FIG. 1 is a partial perspective view of an example embodiment of the invention in connection with a bathroom cabinet.

Referring now to the drawings, FIG. 1 shows a bathroom cabinet 10 in accordance with an example embodiment of the invention. The bathroom cabinet 10 includes a pair of storage units 12 flanking a cabinet base 14 and a center panel 16 hingedly secured to the cabinet base 14. The bathroom cabinet 10 is shown elevated above a floor-mounted vanity 18 having a sink 20 set on a counter 22. As mentioned above, the invention can be incorporated into cabinets and vanities of varying elevations, orientations and mounting locations.

While the bathroom cabinet 10 of the example embodiment includes a storage unit 12 on both the left and right sides of the bathroom cabinet 10 (as viewed in FIG. 1), the bathroom cabinet 10 may include storage units 12 only on one of the left or right sides. Furthermore, the storage units 12 need not extend the distance end to end of the bathroom cabinet 10 (as shown in FIG. 1), but may instead extend merely a portion of the distance. Lastly, multiple, distinct storage units 12 may be used on a single side of the bathroom cabinet 10 (e.g., two storage units 12 extending from one side).

Portions of the bathroom cabinet 10 (e.g., storage units 12, cabinet base 14, and the like) are preferably produced from wood such as white maple, ash, plywood, medium density fiberboard (MDF), and the like. Veneers and laminates may be used to provide aesthetically pleasing surface finishes when manufactured woods (e.g., plywood and MDF) are used. The structure is preferably secured together by a combination of glue and screws to provide a sturdy cohesion between individual pieces and create a robust assembly.

The bathroom cabinet 10 may include various accessories and controls. The center panel 16 is mirrored but for a transparent area to allow a media screen 24, mounted to the back side of the center panel 16, to be visible from the front side of the center panel 16. Faucet controls 26 extend through the center panel 16 and allow control of the faucet (not shown) that is mounted to the bottom side of the cabinet base 14. Speakers 28 are shown mounted to the top of the cabinet base 14 to produce audio (either in connection with the media screen 24 content or separate therefrom); the speakers 28 may also be mounted to the bottom side or sides of the cabinet base 14 or to the center panel 16. Lighting fixtures (not shown) are also provided and are mounted to the bottom side of the cabinet base 14, and may be integrated into the storage units 12 to provide enhanced illumination within the storage units 12. The lighting may be adjusted by a capacitive touch pad (not shown) mounted to the bottom side of the cabinet base 14 and/or in response to the position of the storage unit 12. Additional accessories may be included with the bathroom cabinet 10. For example, the center panel 16 or bottom side of the cabinet base 14 may include an automatic soap dispenser, controls for the media screen 24 and/or speakers 28, and the like.

Figure 2:
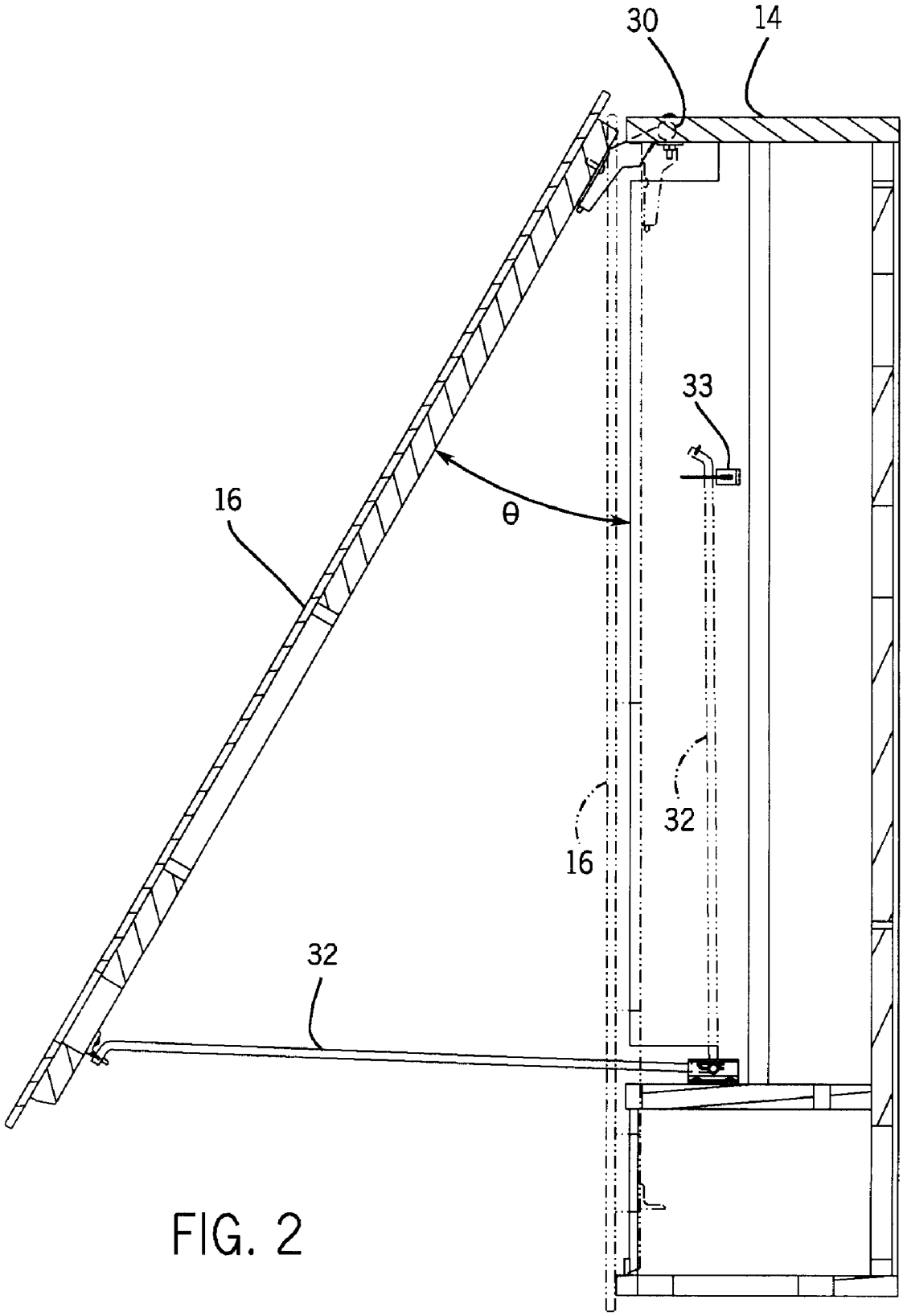
FIG. 2 is a section view thereof taken along line 2-2 of FIG. 1 showing the center panel propped open.

Turning to FIG. 2, the center panel 16 may be hinged to the top of the cabinet base 14 to provide convenient access to the accessories and controls. The center panel 16 pivots about a center panel hinge 30 and is held open by a prop rod 32 pivotally connected to the inside of the cabinet base 14 and releasably connected to the center panel 16. The prop rod 32 preferably props the center panel 16 open at an angle θ of approximately at least 30 degrees from the front of the cabinet base 14. This allows reasonable access to the backside of the center panel 16 and the inside of the cabinet base 14, allowing the required electrical and plumbing connections to be made with relative ease. When the center panel 16 is in the closed position (shown in FIG. 2 by hidden lines) the prop rod 32 is rotated upwards and secured to the prop rod latch 33. The center panel 16 may be secured in the closed position by a fastener at the end opposite the center panel hinge 30.

Figure 3:
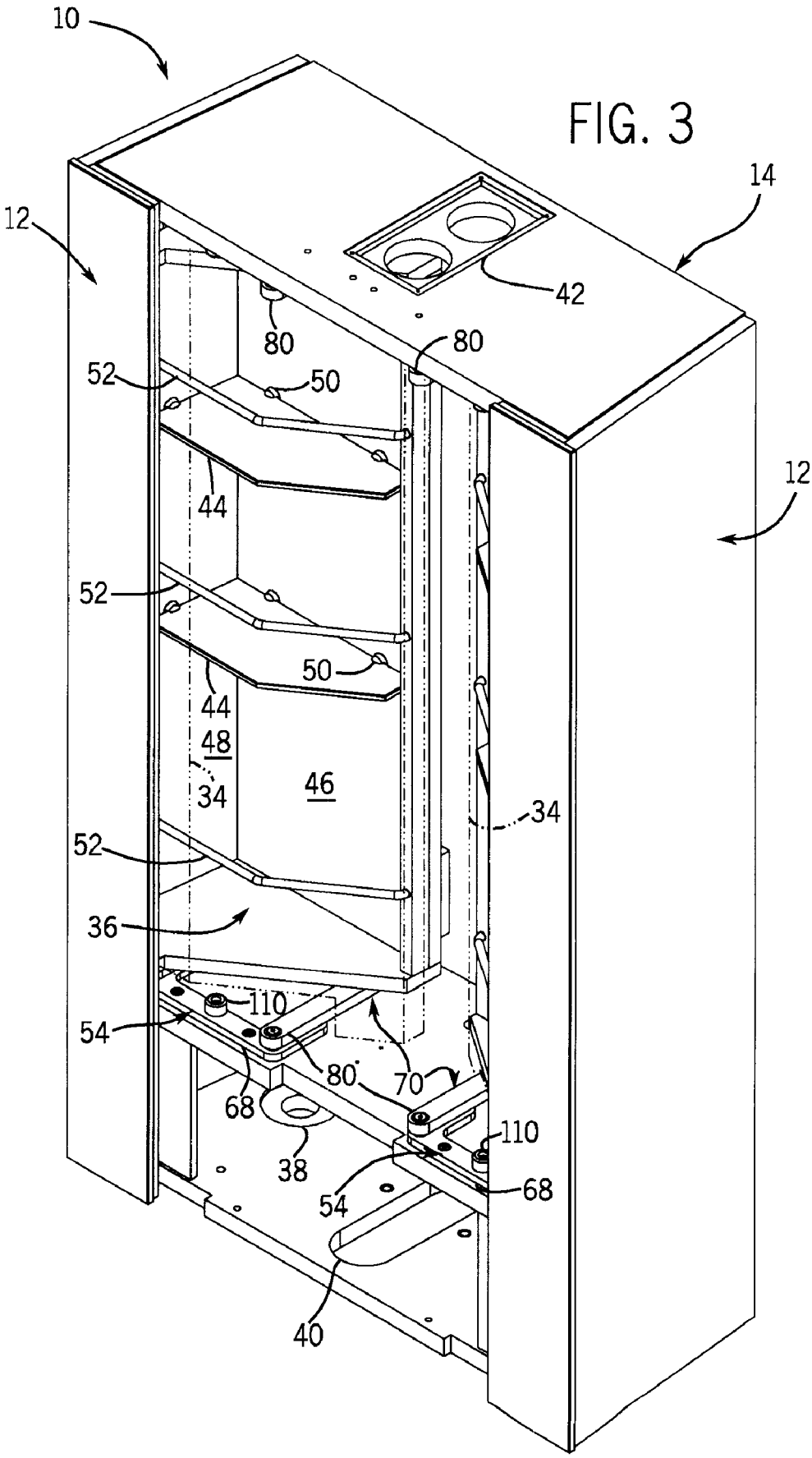
FIG. 3 is a front perspective view thereof with the center panel removed.

Turning to FIG. 3, the bathroom cabinet 10 is shown with the storage units 12 in the closed position and the center panel 16 removed for clarity. Additionally, the partitions 34 are illustrated in hidden lines to allow the storage compartments 36 to be visible. The partitions 34 prevent items placed in the storage units 12 from dislodging from the storage units 12 and interfering with the operation of the storage units 12. FIG. 3 further illustrates a lighting mount 38 and a faucet mount 40 located in the bottom of the cabinet base 14. Also, an additional speaker 28 configuration is shown by the central speaker mount 42 located in the top of the cabinet base 14.

When the invention is embodied in the vertical orientation, each storage unit 12 may include shelves 44, or support platforms, secured to the back wall 46 and side wall 48 of the storage unit 12 by shelf supports 50. Preferably, the shelves 44, or support platforms, are made of glass approximately 5 millimeters in thickness. Greater or fewer shelves 44 may be incorporated and may be produced from other materials (e.g., metal, wood, and plastic). When implemented in the horizontal orientation, the storage units 12 may additionally include shelves 44 longitudinally disposed (not shown) within the storage unit 12 or some combination of shelves 44 and compartments.

The rails 52 of the example embodiment have a tubular cross-section and are secured to the storage unit 12 by a two-step process. First one end is inserted into a blind hole in the side wall 48 and then the opposite end is partially inserted into a counter bored hole in the back wall 46. A screw (not shown) is inserted through the bored hole in the back wall 46 and threaded into the end of the rail 52. In the example embodiment, the rails 52 are preferably made of metallic rods.

Figure 4:
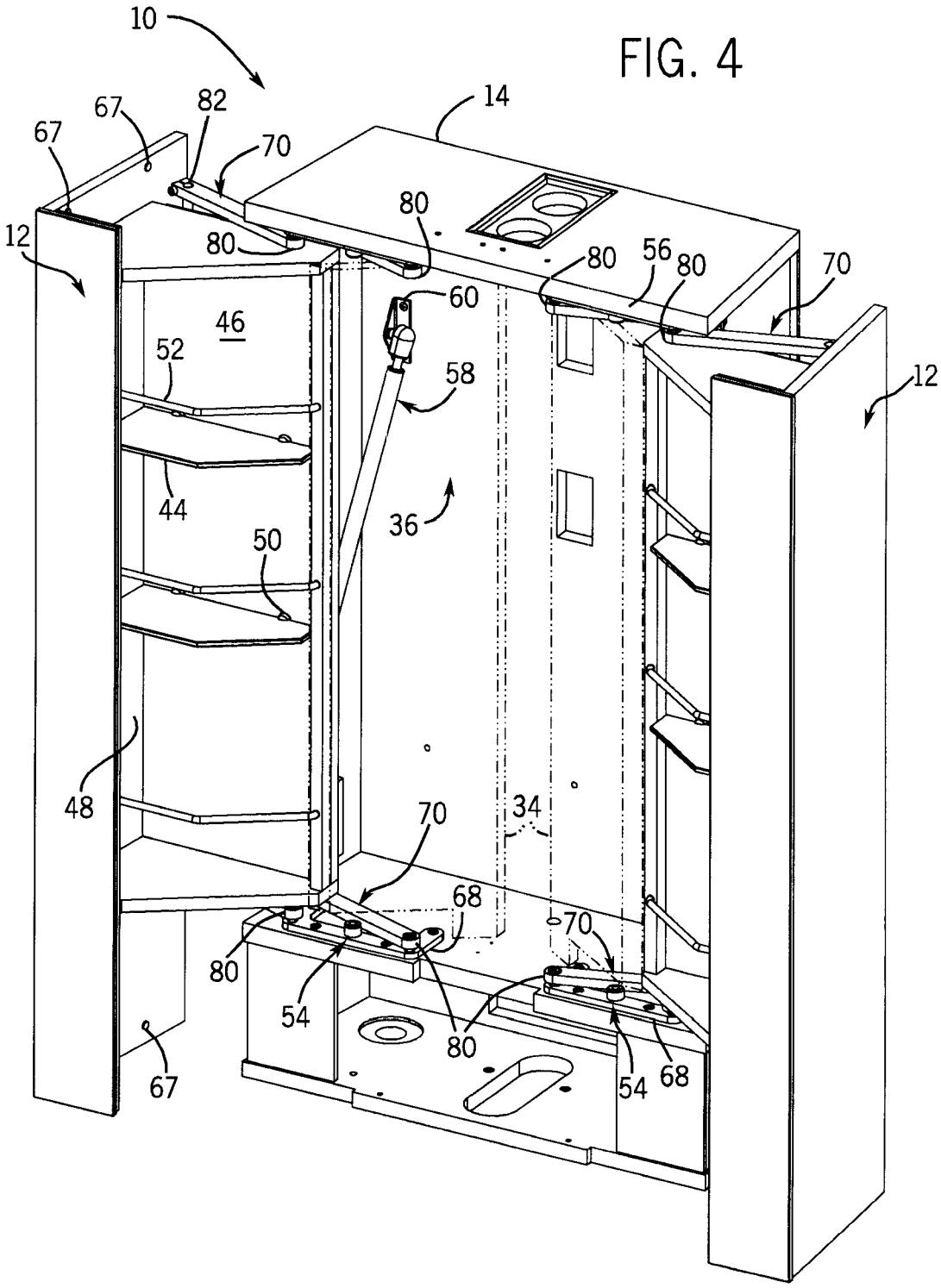
FIG. 4 is a front perspective view thereof showing the storage unit in an opened position.

FIGS. 3 and 4 illustrate the motion of the storage units 12 and associated hinge linkage 54. FIG. 3 shows the orientation of the hinge linkage 54 when the storage units 12 are in the closed position and are substantially housed within the storage compartment 36 of the bathroom cabinet 10. Turning to FIG. 4, the storage units 12 have been moved into the open position. As each storage unit 12 travels from the closed position of FIG. 3 to the open position of FIG. 4, the storage unit 12 travels an arcuate path as the storage unit 12 swings out from the side of the cabinet base 14 and forward (as shown in FIG. 4). Furthermore, in the example embodiment, the plane defined by the back wall 46 of the storage unit 12 remains substantially parallel to the plane defined by the front face 56 of the cabinet base 14 throughout the opening and closing process. The opening and closing process will be described in more detail below.

Figure 5:
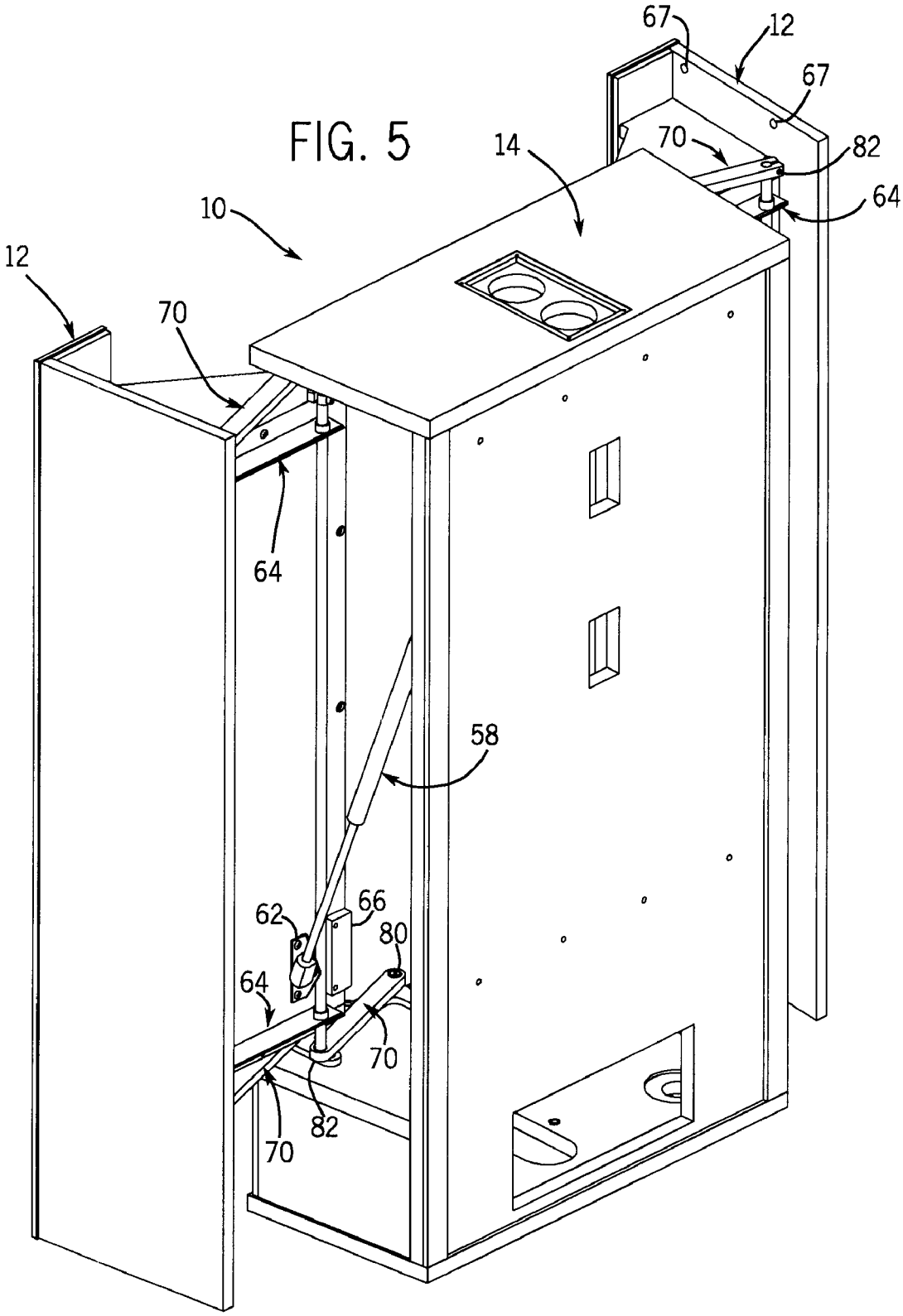
FIG. 5 is a rear perspective view thereof.
Figure 6:
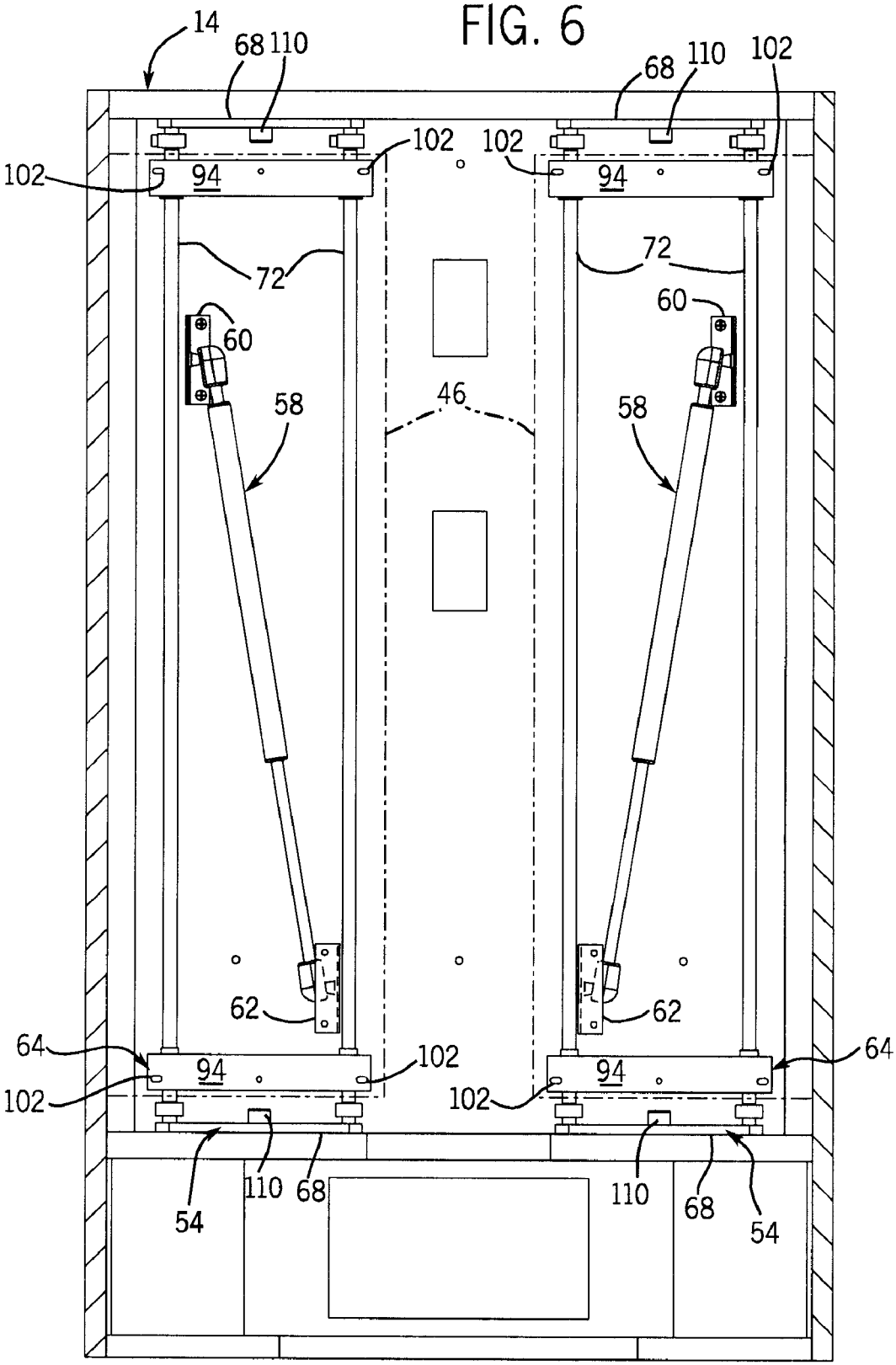
FIG. 6 is a front section view thereof.

Turning to FIGS. 4, 5, and 6, an over-center assist member 58 is incorporated to assist the movement of the storage unit 12 to the open or closed positions depending upon the mounting location of the assist member 58 and the positioning of the storage unit 12. One end of the assist member 58 may be mounted to the cabinet base 14 (shown in FIGS. 4 and 6) or any other suitable support member capable of supporting the assist member 58. One socket end of the assist member 58 is secured over a ball mount 60 mounted to the cabinet base 14. The remaining socket end of the assist member 58 is secured to the extension ball mount 62 mounted to the storage unit 12 (shown in FIGS. 5 and 6) or any other suitable location. For example, one end of the assist member 58 may be directly coupled to the storage unit mount 64. The ball mount 60 and the extension ball mount 62 are positioned relative to the other, both horizontally and vertically, to prescribe the amount of travel the assist member 58 will undergo during operation and the dynamics of the force applied by the assist member 58. A more detailed discussion of the operation of the assist member 58 follows.

In the example embodiment, the assist member 58 is preferably a gas-charged spring biased toward extension. The assist member 58 can be any type of biasing member or configuration (e.g., spring, electromagnetic actuator, counter weight, and the like) provided the desired amount of force is applied given the application requirements. For instance, in the example vertical embodiment, where the storage unit 12 weighs approximately ten pounds and the storage unit 12 is capable of supporting ten to forty pounds, the assist member 58 provides approximately nine pounds force urging the assist member 58 to its fully extended position. As a result, a geometrically dictated amount of force is applied to urge the storage unit 12 toward the opened or closed position.

With further reference to FIG. 5, in addition to the biasing force of the assist member 58, the storage units 12 may be removably restrained in the opened, closed, or intermediate positions by a secondary latch. For example, a storage unit latch 66 may be mounted to the storage unit 12 and couple with a mating latch (not shown) when the storage unit 12 is in the open and/or closed positions. In one embodiment, the storage unit latch 66 may be a magnet that couples to a mating magnet when the storage unit 12 is in predetermined positions. Additionally, bumpers 67 are provided around the periphery of the storage units 12 to cushion the closure of the storage units 12.

With the general movement of the storage units 12 introduced and the overall urging of the assist member 58 described, an example embodiment of the hinge linkage 54 in accordance with the invention is described.

Figure 7:
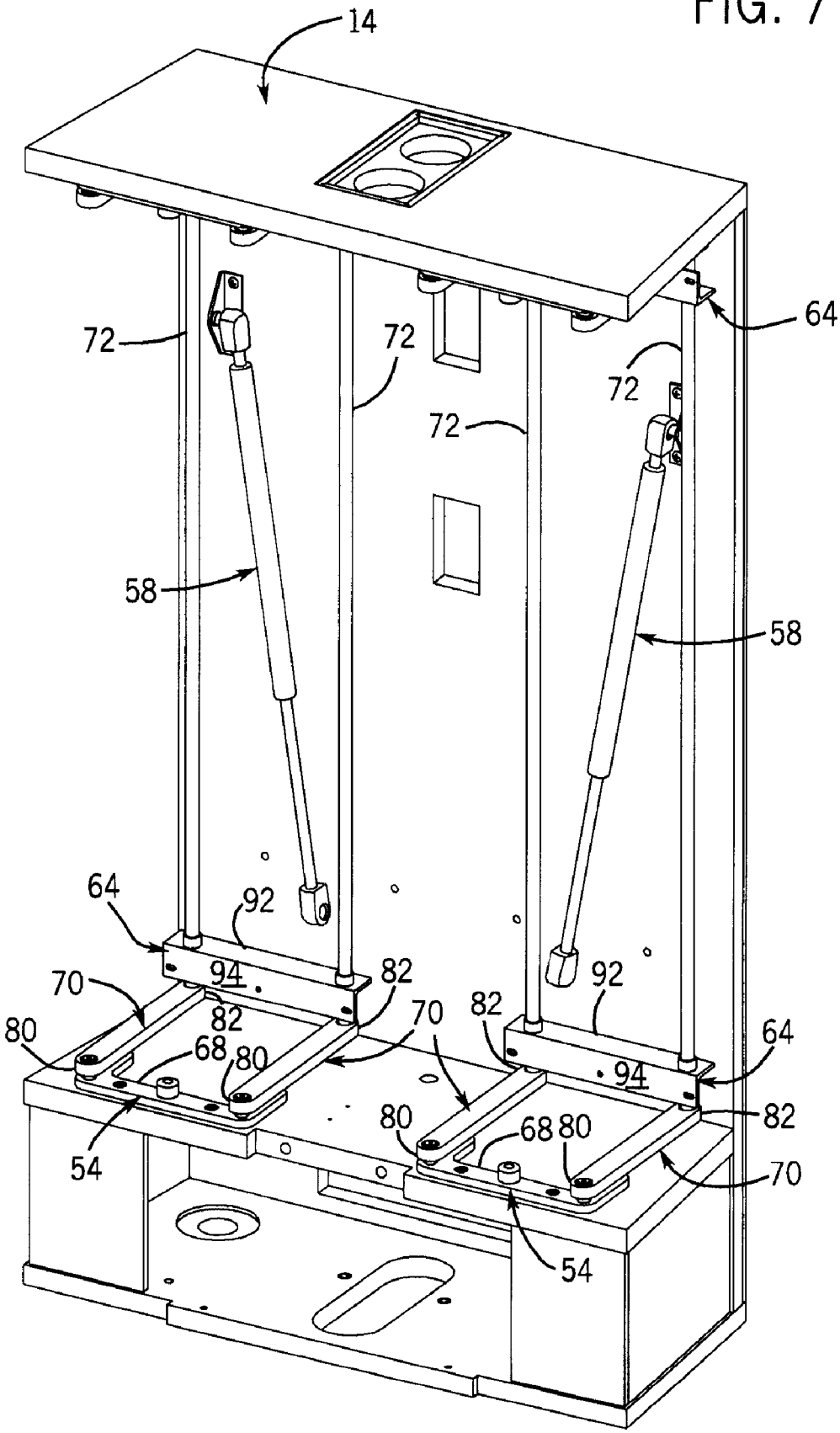
FIG. 7 is a front perspective view thereof with the center panel and storage units removed.

Turning to FIG. 7, the ability of the storage unit 12 to travel the arcuate path and maintain a near constant orientation is provided, in one example embodiment, by the implementation of the hinge linkage 54. In the example embodiment, a hinge linkage 54 is located at both opposite ends of the storage unit 12; however, given ample strength and rigidity, one hinge linkage 54 pivotally coupled to the storage unit 12 and the cabinet base 14 is sufficient to achieve the desired motion. Furthermore, a pair of hinge linkages 54 coupled by a cross-member, while again not necessary, has additional benefits, as discussed below.

Figure 8:
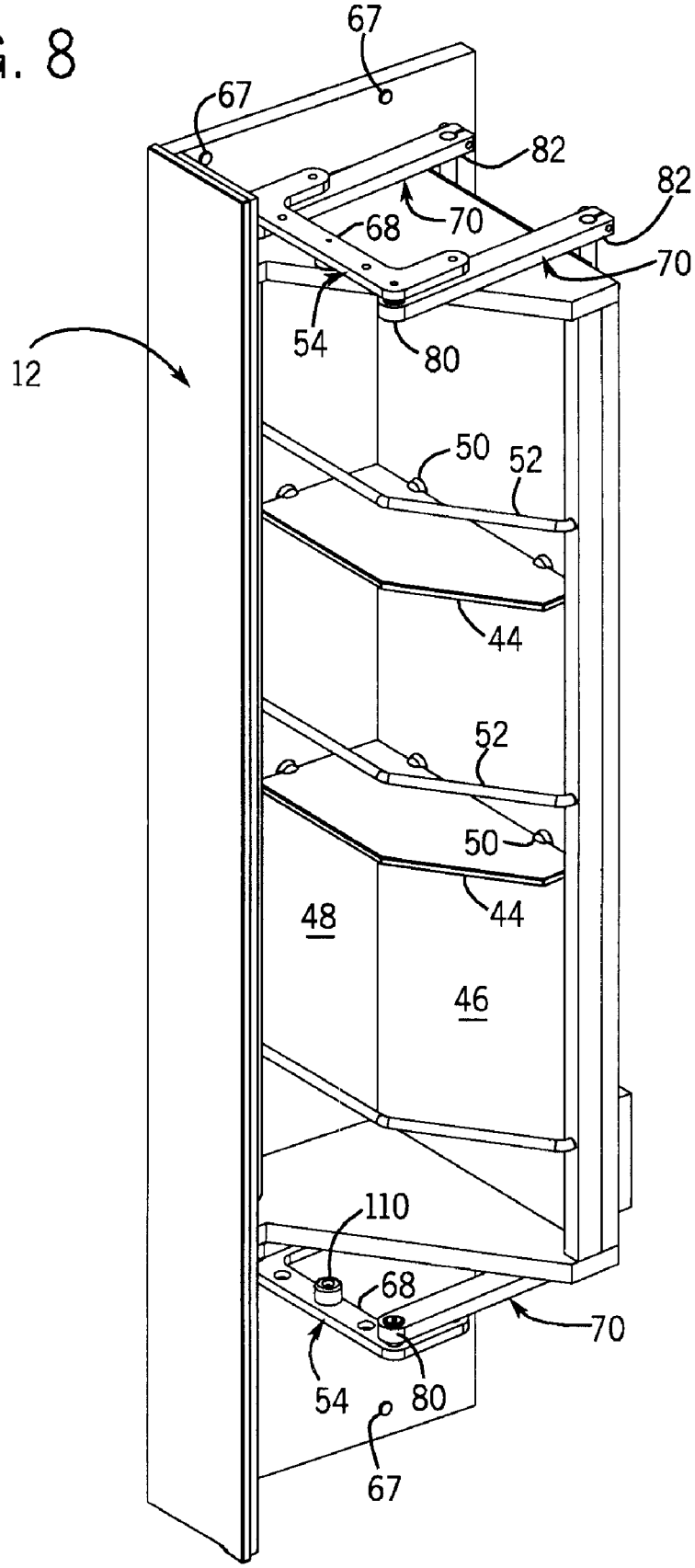
FIG. 8 is a front perspective view showing a storage unit removed from the cabinet.

Turning briefly to FIG. 8, a single storage unit 12 is shown in isolation from the entire bathroom cabinet 10. The hinge linkage 54 is illustrated in the closed position coupled to the hinge linkage 54 through the storage unit mounts 64.

In the example embodiment, a mounting plate 68 is coupled to the cabinet base 14. A set of links 70 is spaced apart and arranged in parallel, and each link 70 has a stationary end 80 rotatably coupled to the mounting plate 68. However, the mounting plate 68 is not required as the link 70 may be directly coupled to the cabinet base 14. When used, the mounting plate 68 provides a secure connection between the links 70 and the cabinet base 14. The links 70 have opposite movable ends 82 fixedly secured to a cross-member, here one end of a pair of parallel spaced apart rods 72.

The rods 72 are rotatably coupled to at least one storage unit mount 64 that is in turn secured to the storage unit 12. The example embodiment includes a pair of storage unit mounts 64 for rotatably coupling the cross-member, and thus hinge linkage 54, to the storage unit 12. However, the storage unit mounts 64 may be integrated with the storage unit 12 or completely absent; for example, where the movable end 82 of the link 70 is directly rotatably coupled to the storage unit 12. The remaining ends of the pair of rods 72 are connected to the movable ends 82 of a second pair of links 70. Lastly, the stationary ends 80 of the second pair of links 70 are rotatably coupled to a mounting plate 68 located at an opposite end of the cabinet base 14.

It is again of note that the storage unit 12 and associated hinge linkage 54, or cross-members, need not extend the entire distance of the bathroom cabinet 10.

The example embodiment includes a cross-member including a pair of rods 72, however, it is not necessary to have any cross-member. The cross-member, here a pair of rods 72, acts to transfer force between the hinge linkages 54 at opposite ends of the storage unit 12 and to minimize binding of the hinge linkages 54 during operation. For example, if the storage unit 12 is large and/or is carrying a significant load, the components (e.g., hinge linkage 54) may begin to deflect and deform, potentially leading to binding. This is especially prevalent when force is applied to an extreme of the storage unit 12 (e.g., a user opening the storage unit 12 by pulling on the bottom corner of the storage unit 12) creating a large uneven moment about the opposite end of the storage unit 12. However, the storage unit 12 can act as a rigid member coupling the hinge linkages 54 to each other; thus, a cross-member is not obligatory. Furthermore, where the cross-member consists of rods 72, one or multiple rods 72 may be used and the rods 72 may have various cross-sections (e.g., rectangular tube, I-beam), provided the rod 72 is capable of rotatably coupling to the storage unit mount 64.

Figure 11:
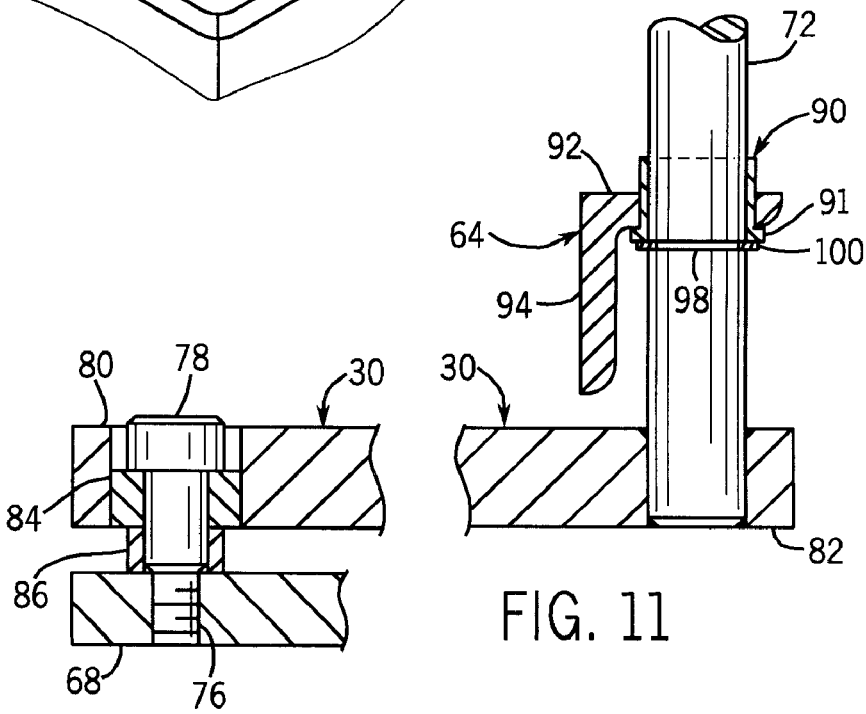
FIG. 11 is an enlarged, broken section view taken along line 11-11 of FIG. 9.
Figures 9, 12:
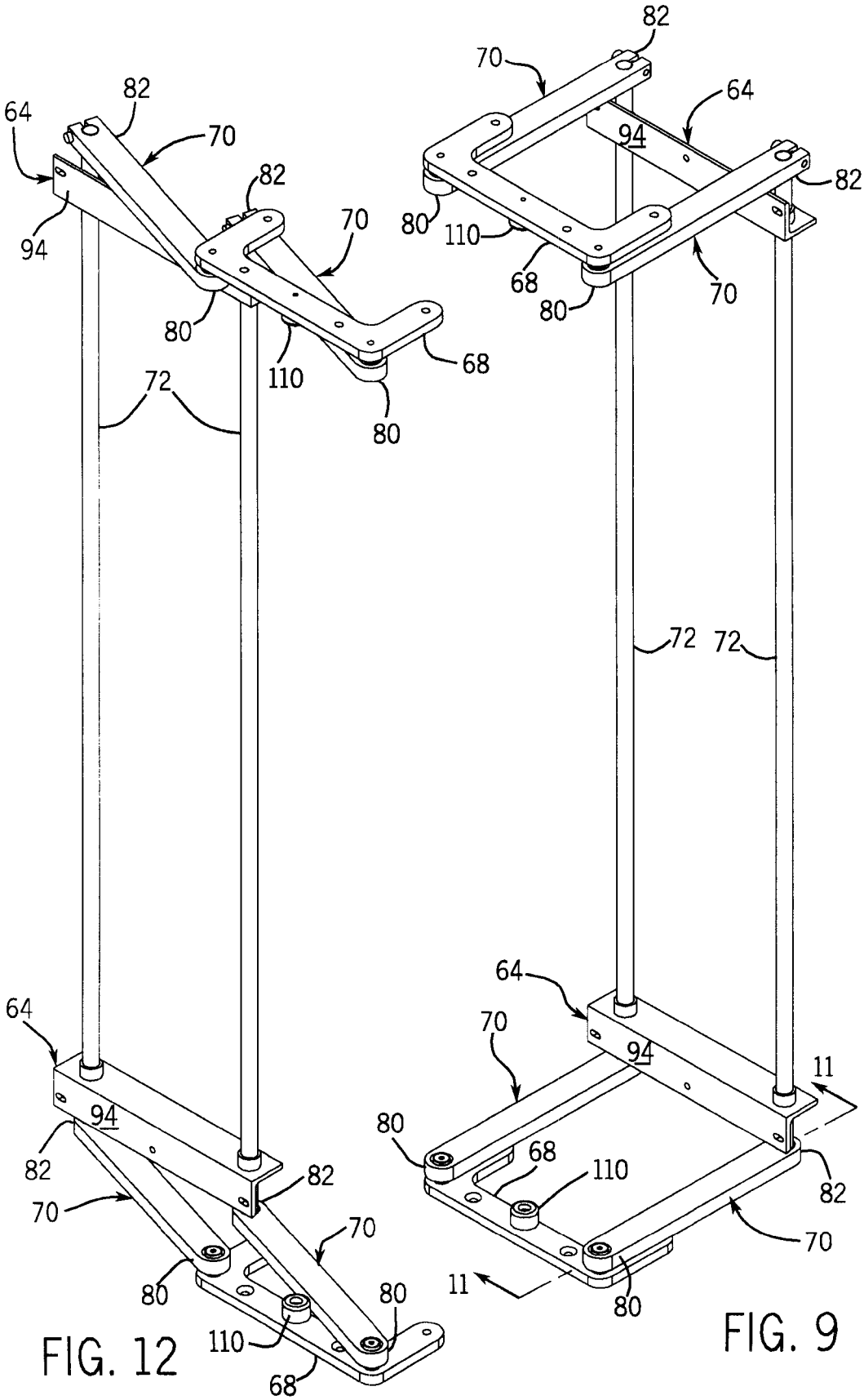
FIG. 9 is a perspective view showing a hinge linkage in a closed position.
FIG. 12 is a perspective view similar to FIG. 9 showing the hinge linkage in an open position.

Turning to FIGS. 9, 10, 11, and 12, the structure and operation of the hinge linkage 54 and cross-member will be discussed. FIG. 9 illustrates the hinge linkage 54 as it appears in a fully closed position and FIG. 12 illustrates the hinge linkage 54 as it appears in a fully opened position. Looking first to FIG. 10, the assembly of the hinge linkage 54 and cross-member will be described starting from the lower end and moving toward the upper end (as it appears in FIG. 9).

The mounting plate 68 is a substantially flat U-shaped plate having four spaced apart, countersunk cabinet base mounting holes 74 for securing the mounting plate 68 to the cabinet base 14 with fasteners, such as screws. Two threaded holes 76 are located near the corners of the U-shaped mounting plate 68 for receiving a respective shoulder bolt 78. A pair of rectangular bar shaped links 70 has a stationary end 80 and a movable end 82, both ends are rounded to provide increased clearance during rotation.

Turning briefly to FIG. 11, the coupling of the stationary ends 80 of the links 70 to the mounting plate 68 is shown in cross-section. The shoulder bolt 78 enters the top side of a hole formed in the stationary end 80 of the link where it abuts a bearing 84. The shoulder bolt 78 continues through a bushing 86 placed between the bearing 84 and the mounting plate 68 to provide clearance between the mounting plate 68 and the link 70 during operation. The shoulder bolt 78 engages the threaded hole 76 in the mounting plate 68. As a result, the links 70, without further restraint, are free to rotate about the respective shoulder bolts 78.

Returning briefly to FIG. 10, the movable ends 82 of the links 70 include chamfered through holes 88 sized to receive one end of a respective rod 72. One end of each rod 72 is fixedly secured in the holes 88, preferably by welding. Thus, the movement of the rods 72 influence the rotation of the links 70 about the stationary ends 80. The storage unit mount 64 is a substantially flat bar having a longitudinal bend defining a top face 92 and a mounting face 94. A pair of spaced apart through holes 96 are formed through the top face 92 for receiving the rods 72. The distance between the holes 96 of the storage unit mount 64 is substantially similar to the distance between the threaded holes 76 in the mounting plate 68 for securing the stationary ends 80 of the links 70. As a result, the links 70 are spaced apart in parallel and rotate in parallel unison throughout the allowable movement, thus maintaining the orientation of the coupled storage unit 12.

Turning again to FIG. 11, a retainer bushing 90 is slid onto each rod 72 and partially through the holes 96 in the top face 92 of the storage unit mount 64. A lip 91 of the retainer bushing 90 abuts the back side of the top face 92. The storage unit mount 64 is prevented from sliding along the rods 72 toward the links 70 by the combination of annular grooves 98 formed in each rod 72 and retaining clips 100 snap fit into the annular grooves 98.

Again returning to FIG. 10, the mounting face 94 of the storage unit mount 64 includes a pair of spaced apart slots 102. The slots 102 establish adjustable mounting locations for the storage unit 12. The location of the storage unit 12 with respect to the storage unit mount 64 can be adjusted to accommodate for variations in the assembly and construction of the components.

Continuing along the rods 72, an additional pair of annular grooves 98 are formed near the opposite end of the rods 72 for use in securing a second set of retainer bushings 90 to a storage unit mount 64 and a mounting plate 68. Note that the storage unit mount 64 is mirrored from the previously discussed storage unit mount 64. This need not be the case; however, in the vertical configuration of the example embodiment, greater mounting stability is achieved. Additionally, note that the lip 91 of the retainer bushings 90 and the annular groove 98 are positioned to prevent the storage unit mount 64 from sliding along the rods 72 toward the lower hinge linkage 54. This is a result of the vertical orientation of the example embodiment and is intended to better support the weight of the storage unit 12 and any items thereon. Where the invention is used in a horizontal (or some intermediate) configuration, the annular grooves 98, retainer bushings 90, and storage unit mount 64 can be positioned most appropriately to restrain the movement of the storage unit mounts 64 against the force of gravity or likely forces applied to the storage units 12.

Figure 10:
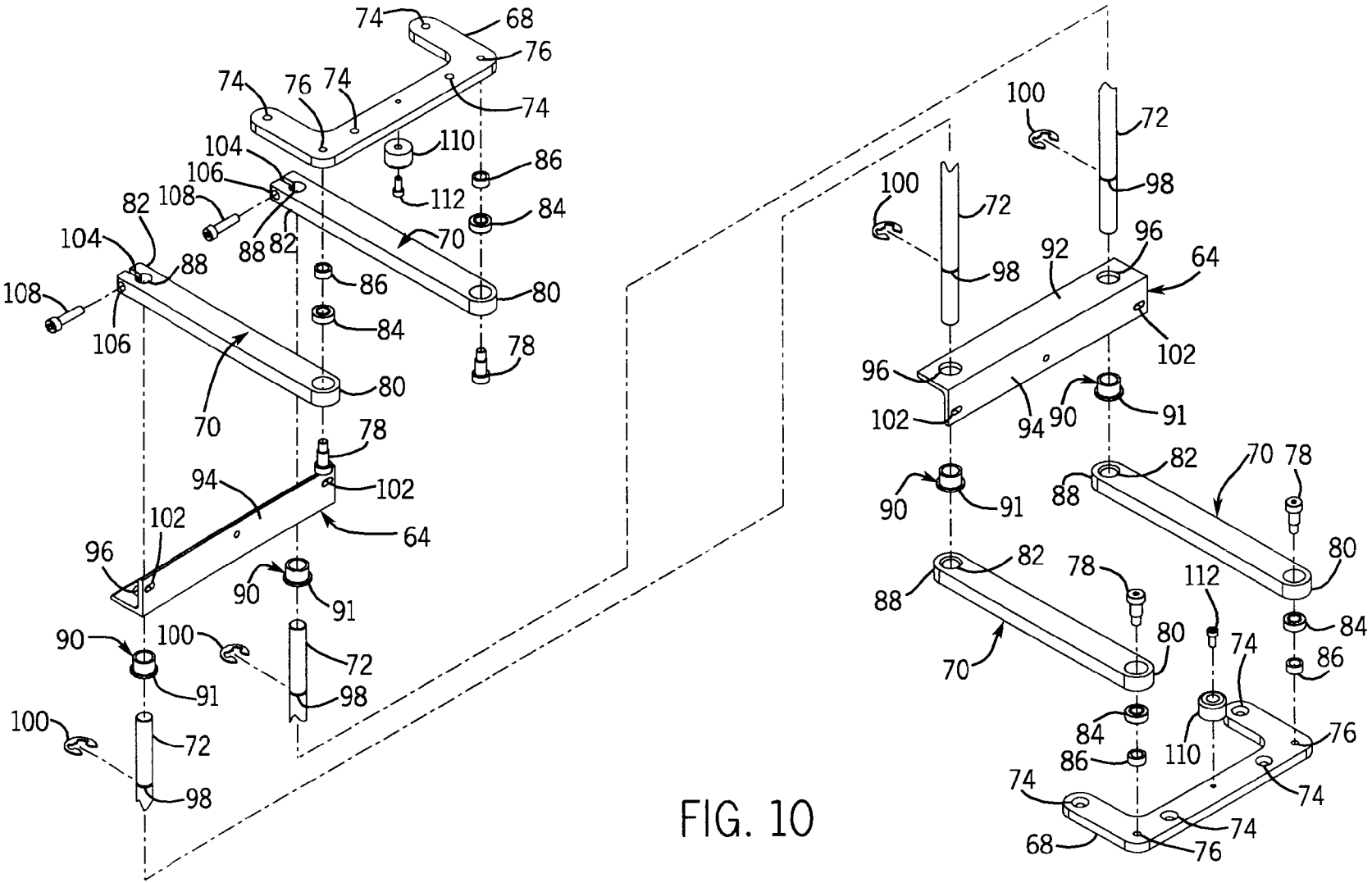
FIG. 10 is an exploded, perspective view thereof.

The movable ends 82 of the links 70 need not be fixedly secured to the rods 72, but instead may be adjustably secured as illustrated by the upper hinge linkage 54 shown in FIG. 10. The movable ends 82 of the links have a slit 104 extending from the holes 88. An adjustment hole 106 extends perpendicular to the slit 104 and extends through half of the movable end 82 into the slit 104. The remaining portion of the adjustment hole 106 is threaded through the other portion of the movable end 82 defined by the slit 104. After the rod 72 is inserted into the hole 88, a cap screw 108 engages the adjustment hole 106 and as the cap screw 108 is tightened, the movable end 82 deflects, decreasing the width of the slit 104 and causing the movable end 82 to clamp to the rod 72. As a result, the distance between one hinge linkage 54 and the opposite hinge linkage 54 can be adjusted by loosening the cap screw 108 (releasing the clamping force on the rod 72), sliding the rod 72 within the hole 88 to the desired position, and retightening the cap screw 108 (clamping the movable end 82 to the rod 72).

An elastomeric stop 110 (shown clearly in FIGS. 10 and 12) is secured by a fastener 112 to the mounting plates 68 to help restrain the movement of the hinge linkages 54 when the storage units 12 are in the opened position.

The elements of the hinge linkage 54 and cross-member of the example embodiment are preferably machined or formed from steel having protective plating or manufactured from stainless steel. In certain environments, use of plastics or composite materials may be used to form the elements.

Figure 13:
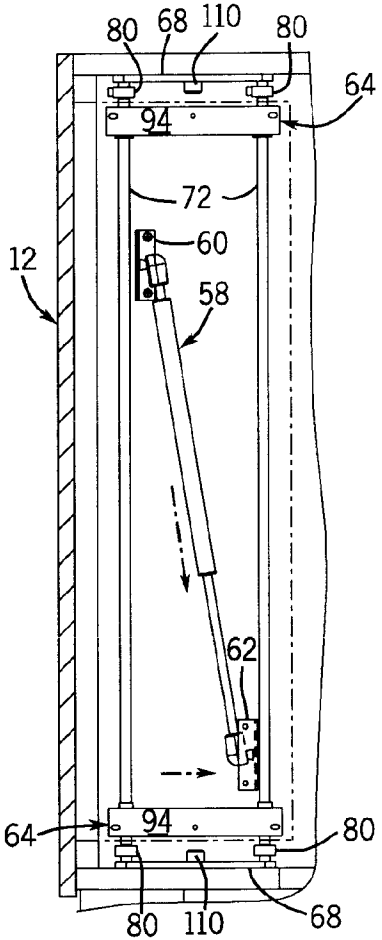
FIG. 13 is a partial section view showing a storage unit in a closed position.

The operation of the hinge linkages 54 and the assist member 58 is best understood with reference to FIGS. 3, 4, 9, 12, and 13-15. First, with reference to FIGS. 3, 9, and 13, the storage unit 12 is shown in the closed position. In the closed position, the links 70 are normal to the respective mounting faces 94 of the storage unit mounts 64. As shown in FIG. 13, which depicts the left storage unit 12, the assist member 58 biases the storage unit 12 toward the closed position due to the offset placement of the ball mount 60 and the extension ball mount 62. A geometrically dictated portion of the force provided by the assist member 58 acts along the horizontal arrow of FIG. 13 to bias the storage unit 12 toward the closed position.

Figure 14:
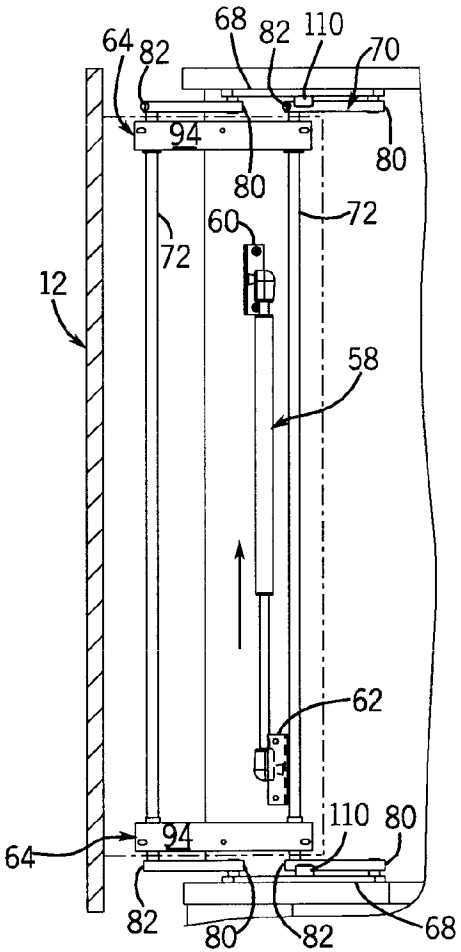
FIG. 14 is a partial section view showing a storage unit in an intermediate position.

Looking to FIG. 14, as the storage unit 12 is opened, the force required to move the storage unit 12 decreases until the ball mount 60 and extension ball mount 62 are aligned along an axis extending normal to the hinge linkages 54, that is, the location at which the assist member 58 is at its minimum overall length and maximum compressed deflection. At this equilibrium point, the hinge linkages 54 are between the extreme orientations depicted in FIGS. 9 and 12. The force provided by the assist member 58 no longer acts in the horizontal direction, instead, the force is in the vertical direction as shown in FIG. 14.

Figure 15:
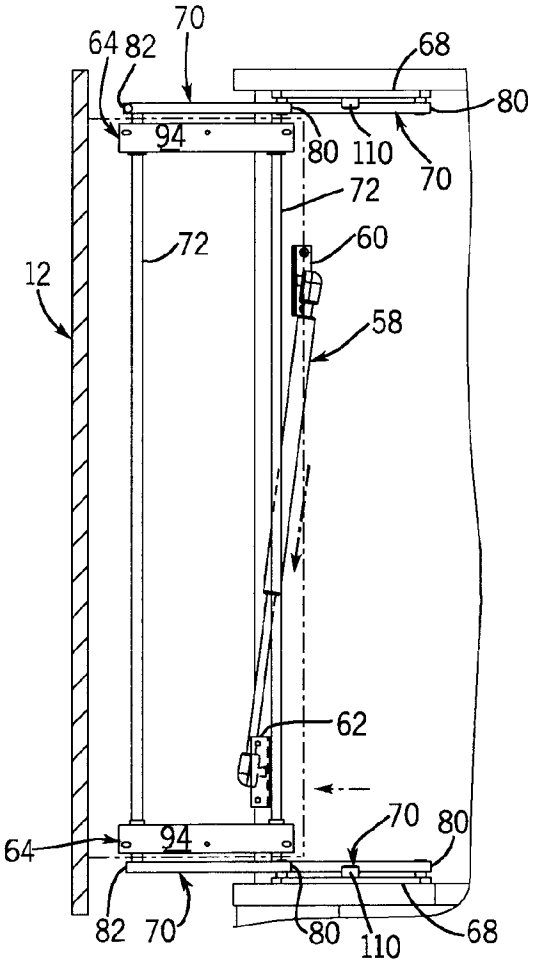
FIG. 15 is a partial section view showing a storage unit in an open position.

Continuing to FIG. 15, as the storage unit 12 moves past the equilibrium point and continues to open, the assist member 58 now biases the storage unit 12 toward the open position shown in FIGS. 4 and 12. Again, a geometrically dictated portion of the force provided by the assist member 58 acts along the horizontal arrow of FIG. 15 to bias the storage unit to the opened position. The stop 110 prevents the links 70 of each hinge linkage 54 from contacting each other and controls the location of the fully opened position of the storage units 12.

Adjusting the force and equilibrium position of the storage units 12 can be accomplished, for example, by increasing or decreasing the force provided by the assist member 58 and/or by altering the relative mounting locations of the ball mount 60 and the extension ball mount 62, thus altering the geometry and associated horizontal and vertical components of the force provided by the assist member 58. For example, increasing the travel of the assist member 58 along its axis (i.e., the maximum compressed deflection) increases the total effort required to move the storage unit 12 from one position to another position. Additionally, lowering the ball mount 60 alters the geometry of the assist member 58 such that a larger portion of the force provided by the assist member 58 must be overcome to change the position of the storage unit 12.

Turning to FIGS. 16 and 17, a horizontal example embodiment is illustrated. In this example embodiment, the storage unit 12 moves out and up from the cabinet base 14. In this orientation, the force provided by the assist member 58 may be increased to provide a lifting force and counteract the additional gravitational forces acting on the storage unit 12. For example, the force provided by the assist member may be increased to fifty pounds force and the mounting locations of the assist member 58 altered to accommodate thirty-five to forty pounds force of items stored in the storage unit 12. Other horizontal configuration considerations have been discussed above; however, the overarching discussion is applicable.

It should be appreciated that merely preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

What is claimed is:

1. A hinge linkage and storage unit, comprising:

a first set of links having opposite stationary and movable ends, the stationary ends thereof being pivotably mounted to the cabinet;

a second set of links having opposite stationary and movable ends, the stationary ends thereof being pivotably mounted to the cabinet; and a cross-member having a set of storage unit mounts mounted to the storage unit and having a set of rods spaced apart and arranged in parallel pivotally coupled to the set of storage unit mounts, wherein a first end of the cross-member is pivotally coupled to the movable ends of the first and second sets of links such that as the first and second sets of links are pivoted, the cross-member moves along an arcuate path while maintaining an essentially constant orientation, wherein the set of storage unit mounts includes an oblong slot adapted to adjust the positioning of the storage unit with respect to the set of storage unit mounts.

2. The hinge linkage and storage unit of claim 1, wherein the cross-member is movable along the arcuate path between a first position, a second position, and an intermediate position between the first position and the second position.

3. The hinge linkage and storage unit of claim 2, further comprising an assist member adapted to bias the cross-member toward the first position when between the first position and the intermediate position and to bias the cross-member toward the second position when between the second position and the intermediate position.

4. The hinge linkage and storage unit of claim 2, wherein the cross-member swings out in a forward direction and to a side of the links as it moves from the first position to the second position.

5. The hinge linkage and storage unit of claim 1, wherein annular grooves are formed in the rods of the cross-member.

6. The hinge linkage and storage unit of claim 5, further comprising retaining clips sized to engage each annular groove to restrain the movement of the set of storage unit mounts along a longitudinal axis of the cross-member.

7. A hinge linkage and storage unit, comprising:

a first set of links having opposite stationary and movable ends, the stationary ends thereof being pivotably mounted to the cabinet;

a second set of links having opposite stationary and movable ends, the stationary ends thereof being pivotably mounted to the cabinet;

a cross-member having a set of storage unit mounts mounted to the storage unit and having a set of rods pivotally coupled to the set of storage unit mounts, each having an annular groove formed therein, wherein the cross-member is pivotally coupled to the movable ends of the first and second sets of links such that as the first and second sets of links are pivoted, the cross-member moves along an arcuate path while maintaining an essentially constant orientation; and retaining clips sized to engage each annular groove to restrain the movement of the set of storage unit mounts along a longitudinal axis of the cross-member.

8. A pullout storage structure for a bathroom cabinet, comprising:

a support member;

a movable storage unit coupled to the support member;

a hinge linkage including a cross-member pivotally coupling a plurality of links coupled to the support member, wherein the cross-member has a set of storage unit mounts mounted to the storage unit and has a set of rods pivotally coupled to the storage unit mounts, wherein the hinge linkage allows the storage unit to move along an arcuate path while maintaining an essentially constant orientation, and wherein the storage unit mounts include an oblong slot adapted to adjust the positioning of the storage unit with respect to the storage unit mounts; and an assist member mounted to bias the storage unit with respect to the support member.

9. The pullout storage structure of claim 8, wherein the storage unit is movable between a first position, a second position, and an intermediate position between the first position and the second position.

10. The pullout storage structure of claim 9, wherein the storage unit swings out in a forward direction and to a side of the support member as it moves from the first position to the second position.

11. The pullout storage structure of claim 10, wherein the assist member biases the storage unit toward the first position when the storage unit is between the first position and the intermediate position and biases the storage unit toward the second position when the storage unit is between the second position and the intermediate position.

12. The pullout storage structure of claim 8, wherein the assist member is directly connected to the storage unit.

13. The pullout storage structure of claim 8, wherein the assist member is a gas-charged spring.

14. The pullout storage structure of claim 8, wherein the plurality of links of the hinge linkage include:

a first set of links having opposite stationary and movable ends, the stationary ends thereof being pivotably mounted to the support member; and a second set of links having opposite stationary and movable ends, the stationary ends thereof being adapted to pivotably mount to the support member.

15. The pullout storage structure of claim 14, wherein each set of links is spaced apart and arranged in parallel.

16. The pullout storage structure of claim 14, wherein the cross-member is pivotally coupled to the movable ends of the first and second sets of links.

17. The pullout storage structure of claim 8, wherein annular grooves are formed in the rods of the cross-member.

18. The pullout storage structure of claim 17, further comprising retaining clips sized to engage each annular groove to restrain the movement of the set of storage unit mounts along a longitudinal axis of the cross-member.

19. The pullout storage structure of claim 8, wherein the support member is a wall-mounted medicine cabinet.

20. The pullout storage structure of claim 19, wherein the medicine cabinet includes a second pullout storage structure.

* * * * *